US005396877A

United States Patent [19]

Amron

[11] Patent Number: 5,396,877

[45] Date of Patent: Mar. 14, 1995

[54] DEVICE FOR CONVERTING AN AIR-PRESSURE WATER GUN TO A DEVICE EJECTING PROJECTILES

[76] Inventor: Alan B. Amron, P.O. Box 42, Woodbury, N.Y. 11797

[21] Appl. No.: 104,841

[22] Filed: Aug. 11, 1993

[51] Int. Cl.[6] ..... F41B 11/00

[52] U.S. Cl. ..... 124/58; 124/1; 124/56

[58] Field of Search ..... 124/56, 58, 71, 72, 124/73, 83, 84, 1; 222/79

[56] References Cited

U.S. PATENT DOCUMENTS

| | | | |
|---|---|---|---|
| 3,262,440 | 7/1966 | Kuhn | 124/83 X |
| 3,415,420 | 12/1968 | White | 222/79 |
| 3,765,396 | 10/1973 | Kienholz et al. | 124/72 X |
| 4,424,972 | 1/1984 | Vinette | 124/56 X |
| 5,113,842 | 5/1992 | Moormann | 124/83 X |
| 5,184,755 | 2/1993 | Brovelli | 222/79 |

*Primary Examiner*—Dennis L. Taylor
*Assistant Examiner*—John A. Ricci
*Attorney, Agent, or Firm*—Cohen, Pontani, Lieberman, Pavane

[57] ABSTRACT

An attachment for converting an air-pressure water gun to a device ejecting projectiles by air pressure includes a hollow barrel portion having structures on the first end portion for fitting over the barrel of an air-pressure water gun. A hollow needle pin is adapted to the fitted within the nozzle of the water gun, and a tube extends from the needle pin to the interior of the first end portion of the barrel to deliver pressurized air from the water gun into the barrel to eject projectiles therefrom.

2 Claims, 1 Drawing Sheet

DEVICE FOR CONVERTING AN AIR-PRESSURE WATER GUN TO A DEVICE EJECTING PROJECTILES

FIELD OF THE INVENTION

The present invention relates to a device which can be attached to the barrel of an air-pressure water gun for enabling the gun to eject projectiles under air pressure.

BACKGROUND OF THE INVENTION

Water guns which operate under air pressure are known, such as the device described in U.S. Pat. No. 5,074,437. Such devices include a water reservoir which can be pressurized by actuation of a piston pump to enable water to be ejected from the nozzle of the water gun as a result of the pressure developed within the water reservoir. It is an object of the present invention to provide an attachment for such water guns which can convert the guns to a device which can eject projectiles such as foam balls.

SUMMARY OF THE INVENTION

According to the present invention, an attachment for converting an air-pressure water gun to a device ejecting projectiles by air pressure includes a hollow barrel element including means on a first end portion thereof for fitting over the barrel of an air-pressure water gun. A hollow needle pin is adapted to be fitted within the nozzle of the water gun, and a tube extends from the needle pin to the first end portion of the barrel. In this way, the accumulator for water and air pressure of the water gun can be charged with air under pressure which can be released by a trigger mechanism to provide pressurized air from the nozzle of the water gun into the barrel of the attachment to forcibly eject a projectile such as a foam ball. In preferred form, the first end portion of the barrel includes a compression spring, and a flexible circular seal is fitted in the opposite end portion. This flexible seal has a circular opening smaller in diameter than the foam balls to be inserted into the barrel and, in this way, a plurality of foam balls can be loaded into the barrel for ejection.

These and other objects, advantages and features of the present invention will become apparent from the detailed description made below of a preferred embodiment of the present invention, said description being made in connections with the accompanying drawing.

BRIEF DESCRIPTION OF THE DRAWING

The FIGURE illustrates an attachment of the present invention.

DETAILED DESCRIPTION OF PREFERRED EMBODIMENT

Figure 1:
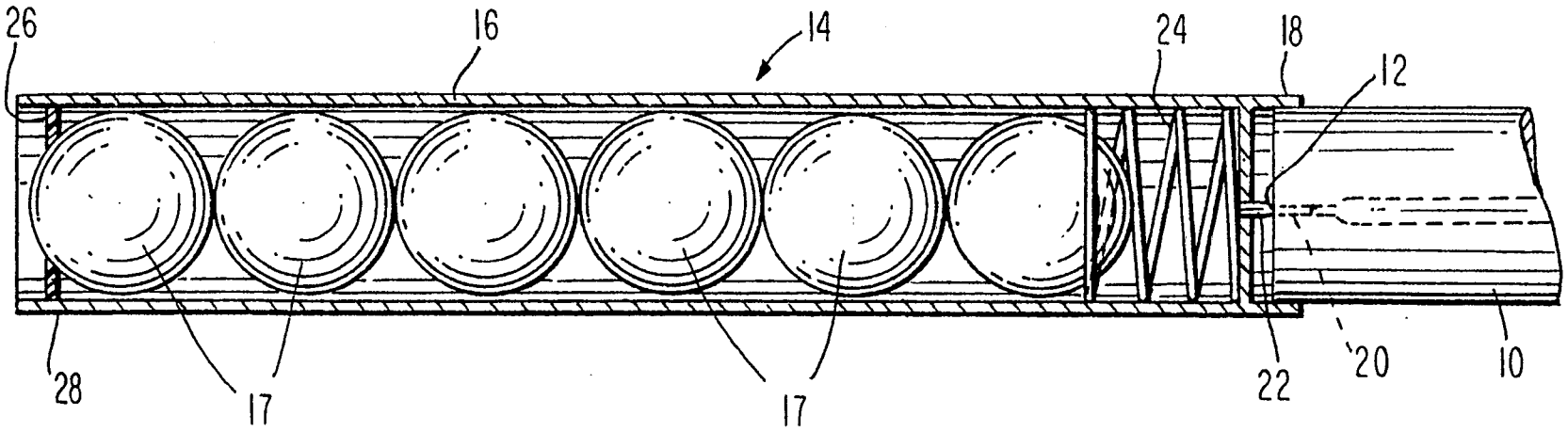

As illustrated schematically in the FIGURE, a barrel 10 of a conventional air-pressure water gun has an outlet nozzle 12. The attachment 14 of the present invention includes a hollow barrel portion 16 which has structures 18 which are adapted to be press fitted over the barrel 10 of the air-pressure water gun. A hollow needle pin 20 is inserted into the nozzle 12 of the water gun; and a flexible tubing 22 extends from the needle pin 20 to the interior of the barrel portion 16.

In this way, the needle pin can be inserted into the nozzle 12 of the water gun and the barrel portion can be press fitted over the barrel end of the water gun to hold the attachment in an extended position from the barrel 10 of an air-pressure watergun.

As will be understood in the art, a coiled compression spring 24 is provided in the end portion of the barrel portion 12. A circular guard 26 formed of resilient material has an opening smaller in diameter than the foam balls to be inserted into the barrel portion 14 and is provided in the forward end portion 28 of the barrel portion. As will be understood, a plurality of foam balls 27 can, consequently, be loaded into the barrel portion 16 by being pressed past the resilient guard 26. The compression spring 24 serves to hold the forwardmost compressible ball against the guard 26.

The conventional air-pressure water gun such as that described in the U.S. Pat. No. 5,074,437 includes an accumulator which can be charged with water, and then a pumping mechanism is provided to force air under pressure into the accumulator. In this way, actuation on the trigger releases water under pressure through the nozzle of the water gun. In operation of the present invention, water is not charged into the pressure accumulator, but instead the accumulator is simply charged with pressurize air by actuation of the pumping mechanism.

In this way, actuation of the trigger mechanism of the conventional air/pressure water guns ejects a pressurized stream of air through the needle pin 20 into the barrel portion 16 to forcibly eject balls from the barrel portion.

My present invention has been described above in conjunction with a preferred embodiment, and my invention is not intended to be limited by the details described above, but by my appended claims.

I claim:

1. An attachment for converting an air-pressure water gun to a device ejecting projectiles by air pressure includes a hollow barrel portion including means on a first end portion thereof for fitting over the barrel of an air-pressure water gun, a hollow needle pin adapted to be fitted within the nozzle of said water gun, and a tube extended from said needle pin to said first end portion of said barrel.

2. An attachment as set forth in claim 1, said barrel portion including a spring element in said first end portion adapted to be compressed by resilient balls loaded in said barrel; and a resilient opening in the forward end portion of said barrel having an opening less than the diameter of said resilient balls.

* * * * *